US012117231B2

(12) United States Patent
Olvera et al.

(10) Patent No.: US 12,117,231 B2
(45) Date of Patent: Oct. 15, 2024

(54) ICE MAKER FOR A REFRIGERATOR AND METHOD FOR SYNCHRONIZING AN IMPLEMENTATION OF AN ICE MAKING CYCLE AND AN IMPLEMENTATION OF A DEFROST CYCLE OF AN EVAPORATOR IN A REFRIGERATOR

(71) Applicant: Electrolux Home Products, Inc., Charlotte, NC (US)

(72) Inventors: Jose Carlos Trejo Olvera, Anderson, SC (US); Thomas W. McCollough, Anderson, SC (US); Raony Barrios, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 192 days.

(21) Appl. No.: 17/910,508

(22) PCT Filed: Mar. 25, 2021

(86) PCT No.: PCT/US2021/024035

§ 371 (c)(1),
(2) Date: Sep. 9, 2022

(87) PCT Pub. No.: WO2021/206915

PCT Pub. Date: Oct. 14, 2021

(65) Prior Publication Data

US 2023/0137486 A1 May 4, 2023

Related U.S. Application Data

(62) Division of application No. 16/844,073, filed on Apr. 9, 2020.

(51) Int. Cl.
*F25C 1/24* (2018.01)
*F25C 1/25* (2018.01)
(Continued)

(52) U.S. Cl.
CPC ..... *F25D 17/065* (2013.01); *F25C 1/24* (2013.01); *F25C 1/25* (2018.01); *F25C 5/22* (2018.01);
(Continued)

(58) Field of Classification Search
CPC .. F25D 17/065; F25D 29/00; F25D 2317/061; F25D 2317/0681;
(Continued)

(56) References Cited

U.S. PATENT DOCUMENTS 5,230,605 A 7/1993 Yamaguchi
6,438,988 B1 8/2002 Paskey
(Continued)

FOREIGN PATENT DOCUMENTS

KR 100716254 5/2007

OTHER PUBLICATIONS

International Search Report for PCT/US2021/024035, dated Aug. 25, 2021, 4 pages.
(Continued)

*Primary Examiner* — Cassey D Bauer
(74) *Attorney, Agent, or Firm* — Pearne & Gordon LLP

(57) ABSTRACT

An ice maker (126) including an ice maker frame having an air inlet provided at a first end thereof. An ice tray (144) is rotatably secured to the ice maker frame and configured to form ice pieces therein. An air handler (142) includes an outlet diffuser having a central body defined by a first wall—and a radially spaced apart second wall, wherein a plurality of radially extending fins are disposed between the first and second walls. Each of the fins is spaced apart, one from the other, along an outer peripheral surface of the first wall. In an installed position, the outlet diffuser is disposed directly adjacent the air inlet at the first end of the ice maker frame. A method is provided for synchronizing an ice
(Continued)

making cycle of an ice making unit and a defrost cycle of an evaporator.

10 Claims, 13 Drawing Sheets

(51) Int. Cl.
*F25C 5/20* (2018.01)
*F25D 17/06* (2006.01)
*F25D 21/00* (2006.01)
*F25D 29/00* (2006.01)

(52) U.S. Cl.
CPC ..... *F25D 21/004* (2013.01); *F25D 29/00* (2013.01); *F25C 2400/10* (2013.01); *F25D 2317/061* (2013.01); *F25D 2317/063* (2013.01); *F25D 2317/0681* (2013.01)

(58) Field of Classification Search
CPC . F25D 21/00–21/125; F25C 1/25; F25C 5/22; F25C 1/24; F25C 21/004; F25C 2400/10; F25C 2700/00; F25C 2600/00–2600/04
See application file for complete search history.

(56) References Cited

U.S. PATENT DOCUMENTS

| | | | |
|---|---|---|---|
| 7,739,884 | B2 | 6/2010 | Jeong et al. |
| 8,281,613 | B2 | 10/2012 | An et al. |
| 8,453,475 | B2 | 6/2013 | Shin et al. |
| 8,863,549 | B2 | 10/2014 | Cho et al. |
| 9,829,235 | B2 | 11/2017 | Visin |
| 9,879,896 | B2 | 1/2018 | Koo |
| 10,605,511 | B2 | 3/2020 | Bertolini et al. |
| 2002/0004008 | A1 | 1/2002 | Miyata |
| 2005/0008478 | A1 | 1/2005 | Chang |
| 2008/0000238 | A1 | 1/2008 | Ribaud |
| 2008/0034780 | A1 | 2/2008 | Lim |
| 2008/0236187 | A1 | 10/2008 | Kim |
| 2008/0295539 | A1 | 12/2008 | An |
| 2009/0288441 | A1 | 11/2009 | Fotiadis |
| 2010/0218542 | A1* | 9/2010 | McCollough ..... F25D 21/14 700/275 |
| 2010/0300137 | A1 | 12/2010 | Lim |
| 2012/0090347 | A1 | 4/2012 | Gross |
| 2012/0282117 | A1 | 11/2012 | Takahashi |
| 2013/0319030 | A1 | 12/2013 | Nguyen |
| 2013/0327083 | A1 | 12/2013 | Cho |
| 2014/0047813 | A1 | 2/2014 | Frailich |
| 2014/0202444 | A1 | 7/2014 | Dobie |
| 2014/0260300 | A1 | 9/2014 | Chila |
| 2015/0330695 | A1 | 11/2015 | Miller |
| 2016/0370049 | A1 | 12/2016 | Yang |
| 2017/0314842 | A1 | 11/2017 | Lee |
| 2017/0363339 | A1 | 12/2017 | Malisi et al. |
| 2018/0087814 | A1 | 3/2018 | Han |
| 2018/0274844 | A1 | 9/2018 | Lee |
| 2018/0313593 | A1 | 11/2018 | Olvera et al. |
| 2019/0017518 | A1 | 1/2019 | Brown |
| 2019/0145686 | A1 | 5/2019 | Kim |
| 2019/0293336 | A1 | 9/2019 | Bertolini et al. |
| 2019/0331395 | A1 | 10/2019 | Choi |
| 2021/0172644 | A1 | 6/2021 | Tambakhe |
| 2021/0172668 | A1 | 6/2021 | Park |
| 2021/0278085 | A1 | 9/2021 | Gandikota |

OTHER PUBLICATIONS

Partial International Search Report for PCT/US2021/024035, dated Jul. 1, 2021, 2 pages.

Circumferential Definition & Meaning—Merriam Webster, https://www.merriam-webster.com/dictionary/circumference, retrieved on Aug. 4, 2022.

* cited by examiner

ICE MAKER FOR A REFRIGERATOR AND METHOD FOR SYNCHRONIZING AN IMPLEMENTATION OF AN ICE MAKING CYCLE AND AN IMPLEMENTATION OF A DEFROST CYCLE OF AN EVAPORATOR IN A REFRIGERATOR

CROSS-REFERENCE TO RELATED APPLICATIONS

This application is a national stage entry of PCT/US2021/024035, filed on 2021 Mar. 25, that claims the benefit of U.S. application Ser. No. 16/844,073, filed 2020 Apr. 9, the entire disclosures of which are hereby incorporated herein by reference

FIELD OF THE INVENTION

This application relates generally to an ice maker for a refrigerator, and more particularly, an ice maker comprising an air handler having an outlet diffuser that is disposed adjacent an air inlet in an ice maker frame, and a method for synchronizing an implementation of an ice making cycle with an implementation of a defrost cycle of an evaporator of the refrigerator.

BACKGROUND OF THE INVENTION

Conventional refrigeration applications, such as domestic refrigerators, typically have ice makers that produce ice pieces for user consumption. Such ice makers generally include a fan configured to direct a flow of cool air toward an ice tray positioned within the ice maker. The flow of air directed from the fan to the ice tray is often rebounded due to obstacles positioned within the direction of the airflow path. As such, the airflow often does not engage the entirety of the ice tray. Moreover, due to conventional fan configurations, a vortex in the airflow may occur, which also results in the entirety of the ice tray not being "washed" with the flow of cool air.

Furthermore, the forming and harvesting of such ice pieces are generally dependent on several variables, such as temperature and time. Refrigerators that employ ice makers often include an evaporator that cools the air within the ice maker. This evaporator may be specific to the ice maker (i.e., provides cool air to only the ice maker) or may be associated with other storage compartments of the refrigerator. Additionally, defrost systems are also included and are configured to defrost the evaporator. Such defrost systems provide heat to the evaporator to remove any frost formed thereon.

If the defrost system is operational while the ice maker is manufacturing ice pieces, then the above-mentioned variables may be negatively affected such that harvesting of the ice pieces is delayed. Moreover, the heat generated by the defrost system may inadvertently raise the temperature of the harvested ice pieces as well as the structural components of the ice maker and/or ice bin. As such, all warmed components of the ice maker must be cooled down to proper operational temperatures during the ice making cycle. To accomplish this, additional time and cold air are required. Accordingly, implementation of the defrost system during ice piece manufacturing negatively impacts the overall efficiency of the ice forming process.

BRIEF SUMMARY OF THE INVENTION

In accordance with one aspect, there is provided an ice maker for a refrigeration appliance. The ice maker comprises an ice maker frame that extends between a first end and a second end. The ice maker frame includes an air inlet provided at the first end of the ice maker frame. An ice tray is rotatably secured to the ice maker frame and is configured to form ice pieces therein. The ice maker further comprises an air handler including an outlet diffuser having a central body defined by a first wall. The first wall is peripherally surrounded by, and radially spaced apart from, a second wall. A plurality of radially extending fins are disposed between the first wall and the second wall. Each of the plurality of radially extending fins is spaced apart, one from the other, along an outer peripheral surface of the first wall. In an installed position, the outlet diffuser is disposed directly adjacent the air inlet provided at the first end of the ice maker frame.

The central body is provided at a radial center of the outlet diffuser. Additionally, the air inlet of the ice maker frame comprises a first wall that is peripherally surrounded by, and radially spaced apart from, a second wall, and a projection rib that radially extends between the first and second walls of the air inlet. The first wall of the outlet diffuser and the first wall of the air inlet are both cylindrical in shape, and the first wall of the outlet diffuser is axially aligned with the first wall of the air inlet. The second wall of the outlet diffuser is peripherally surrounded by the second wall of the air inlet. Moreover, the ice maker frame further comprises a cylindrical connection member that is peripherally surrounded by the first wall of the air inlet, the cylindrical connection member being configured to receive a pin of the ice tray in order to rotatably support the ice tray.

Still further, the air handler further comprises a housing, and the outlet diffuser is formed integral with the housing. A fan is disposed within the housing. The fan is configured to direct an airflow out of the outlet diffuser and into the air inlet of the ice maker frame. The fan includes a blade having a pitch that is opposite to a pitch of each of the plurality of radially extending fins of the outlet diffuser. Additionally, an evaporator and a defrost heater are further disposed within the housing.

In accordance with another aspect, there is provided a refrigeration appliance comprising an inner liner that defines a storage compartment and an outer cabinet that partially encloses the inner liner. A door is connected to the cabinet and is configured to provide selective access to the storage compartment. An ice maker is provided within the storage compartment and is configured to manufacture ice pieces.

The ice make comprises an ice maker frame extending between a first end and a second end. The ice maker frame includes an air inlet provided at the first end of the ice maker frame. An ice tray is rotatably secured to the ice maker frame and is configured to form ice pieces therein. The ice maker further comprises an air handler including an outlet diffuser having a central body defined by a first wall. The first wall is peripherally surrounded by, and radially spaced apart from, a second wall. A plurality of radially extending fins are disposed between the first wall and the second wall. Each of the plurality of radially extending fins is spaced apart, one from the other, along an outer peripheral surface of the first wall. Further, in an installed position, the outlet diffuser is disposed directly adjacent the air inlet provided at the first end of the ice maker frame.

Additionally, the storage compartment comprises a fresh food compartment and a freezer compartment. The fresh food compartment is disposed vertically above the freezer compartment and is separated therefrom via a horizontal mullion. The ice maker is provided within the fresh food compartment.

Moreover, the air inlet of the ice maker frame further comprises a first wall that is peripherally surrounded by, and radially spaced apart from, a second wall. The first wall of the outlet diffuser and the first wall of the air inlet are both cylindrical in shape. The first wall of the outlet diffuser is axially aligned with the first wall of the air inlet, and the central body is provided at a radial center of the outlet diffuser. The second wall of the outlet diffuser is peripherally surrounded by the second wall of the air inlet.

Further still, the air handler further comprises a housing that houses a fan configured to direct an airflow out of the outlet diffuser and into the air inlet of the ice maker frame. The fan includes a blade having a pitch that is opposite to a pitch of each of the plurality of radially extending fins of the outlet diffuser.

In accordance with yet a further aspect, there is provided an ice maker for a refrigeration appliance. The ice maker includes an ice maker frame having an air inlet provided at a first end thereof. The air inlet comprises a first wall peripherally surrounded by, and radially spaced apart from, a second wall, wherein a projection rib radially extends from the first wall to the second wall of the air inlet. A cylindrical connection member is peripherally surrounded by the first wall of the air inlet. The ice maker further includes an ice tray configured to form ice pieces therein. The ice tray has a first end including a pin. The pin is received within the cylindrical connection member of the air inlet to rotatably secure the ice tray to the ice maker frame. The ice maker also includes an air handler comprising a housing having an outlet diffuser integrally formed therewith. The outlet diffuser comprises a central body provided at a radial center of the outlet diffuser. The central body is defined by a first wall, the first wall being peripherally surrounded by, and radially spaced apart from, a second wall, wherein a plurality of radially extending fins are disposed between the first wall and the second wall. Each of the plurality of radially extending fins is spaced apart, one from the other, along an outer peripheral surface of the first wall.

The first wall of the outlet diffuser and the first wall of the air inlet are both cylindrical in shape. The first wall of the outlet diffuser is axially aligned with the first wall of the air inlet, and the second wall of the outlet diffuser is peripherally surrounded by the second wall of the air inlet. A fan is disposed within the housing and includes a blade having a pitch that is opposite to a pitch of each of the plurality of radially extending fins of the outlet diffuser such that, during an operating state of the fan, the fan is configured to direct an airflow out of the outlet diffuser and into the air inlet of the ice maker frame in a substantially linear direction.

In accordance with another aspect, there is provided a method for synchronizing an implementation of an ice making cycle of an ice making unit of a refrigerator and an implementation of a defrost cycle of an evaporator or evaporators associated with the ice making unit and the refrigerator. The ice making cycle includes a filling phase, a freezing phase, and a harvesting phase. The method comprises the steps of determining whether an upcoming defrost cycle is scheduled to begin when an ice making unit is in a first portion of an ice making cycle or a second portion of the ice making cycle.

If the upcoming defrost cycle is scheduled to begin when the ice making unit is in the second portion of the ice making cycle, then the method further comprises the step of delaying initiation of the upcoming defrost cycle until after the ice making cycle has finished. Alternatively, if the upcoming defrost cycle is scheduled to begin when the ice making unit is in the first portion of the ice making cycle, then the method further comprises the step of immediately initiating the upcoming defrost cycle by energizing a heating element.

Further, the ice making unit is disposed in one of a fresh food compartment or a freezer compartment of the refrigerator. Additionally, a duration of time between the upcoming defrost cycle and a previous defrost cycle is equal to or greater than a predetermined minimum duration of time. The predetermined minimum duration of time is based on a minimum operating time of a compressor associated with the refrigerator.

Moreover, the step of delaying initiation of the upcoming defrost cycle until after the ice making cycle has finished includes repeated inquiries to the ice making unit from a controller of the refrigerator. The repeated inquiries are performed periodically until it is determined that the ice making unit is not in the freezing phase, the harvesting phase, or the ice filling phase of the ice making cycle.

Additionally, the method further comprises a step of determining if the step of delaying initiation of the upcoming defrost cycle exceeds a predetermined maximum period of time. If it is determined that the predetermined maximum period of time has been exceeded, then aborting the ice making cycle and immediately initiating the upcoming defrost cycle.

Further yet, before the step of determining whether the upcoming defrost cycle is scheduled to begin when the ice making unit is in the first portion of the ice making cycle or the second portion of the ice making cycle, a controller calculates a time until the upcoming defrost cycle is scheduled to begin. Only if the calculated time is less than or equal to a predetermined time does the step of determining whether the upcoming defrost cycle is scheduled to begin when the ice making unit is in the first portion of the ice making cycle or the second portion of the ice making cycle occur.

Moreover, the step of determining whether the ice making unit is in the first portion of the ice making cycle or the second portion of the ice making cycle is performed by a controller. The first portion of the ice making cycle comprising at least one of a filling phase, a freezing phase, and a harvesting phase, and wherein the second portion of the ice making cycle comprises the others of the filling phase, the freezing phase, and the harvesting phase. Alternatively, the first portion of the ice making cycle comprises a first half of time of an overall operation time of the ice making cycle, and the second portion of the ice making cycle comprises a second, subsequent half of time of the overall operation time of the ice making cycle.

DESCRIPTION OF EXAMPLE EMBODIMENTS

Figure 1:
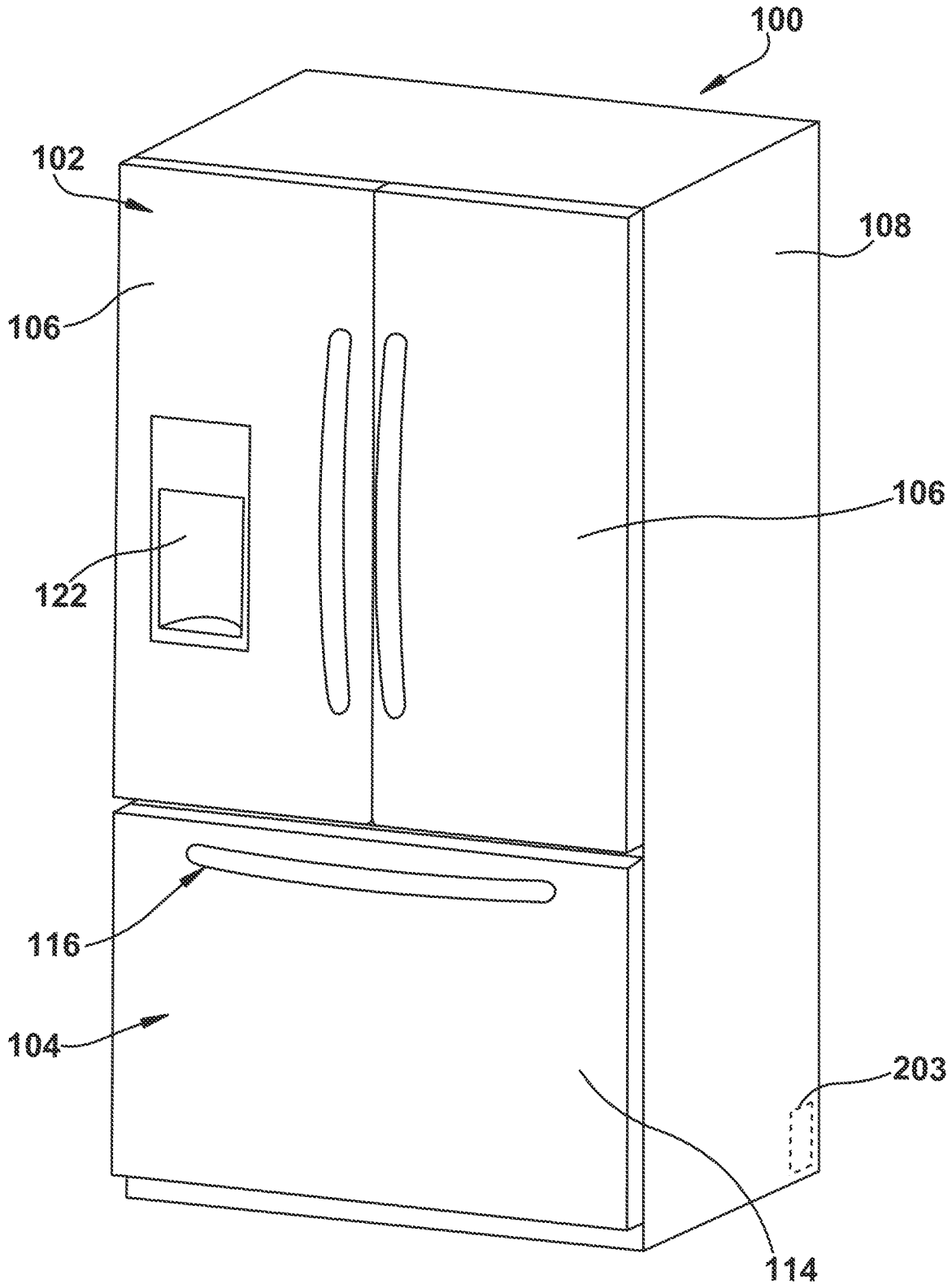
FIG. 1 is a front perspective view of a refrigerator.

Referring now to the drawings, FIG. 1 shows a refrigeration appliance in the form of a domestic refrigerator, indicated generally at 100. Although the detailed description that follows concerns a domestic refrigerator 100, the invention can be embodied by refrigeration appliances other than a domestic refrigerator 100. Further, an embodiment is described in detail below and shown in the figures as a bottom-mount configuration of a refrigerator 100, including a fresh food compartment 102 disposed vertically above a freezer compartment 104. It is to be understood that other configurations are contemplated, for example, a top-mount refrigerator (i.e., fresh food compartment disposed vertically below the freezer compartment), a side by side refrigerator (i.e., fresh food compartment disposed laterally adjacent the freezer compartment), a single compartment refrigerator (i.e., having only a fresh food compartment or a freezer compartment), refrigerators including variable climate zone compartments, etc.

One or more doors 106 are pivotally coupled to a cabinet 108 of the refrigerator 100 to restrict and grant access to the fresh food compartment 102. The door(s) 106 can include a single door that spans the entire lateral distance across the entrance to the fresh food compartment 102, or can include a pair of French-type doors 106, as shown in FIG. 1, that collectively span the entire lateral distance of the entrance to the fresh food compartment 102 to enclose the fresh food compartment 102.

Figure 2:
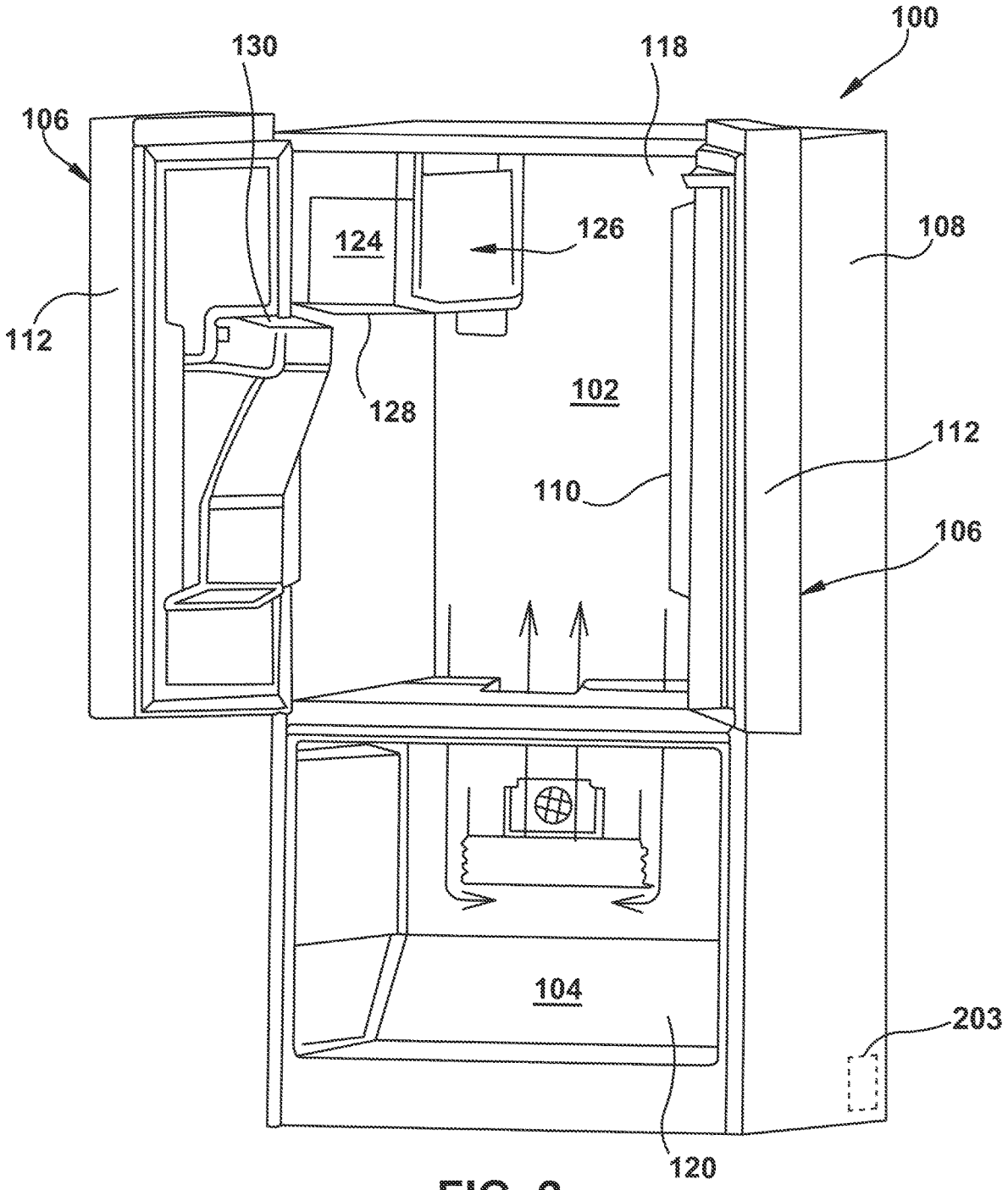
FIG. 2 is a front perspective view of the refrigerator in FIG. 1 showing doors of a fresh food compartment in an opened position and a door of a freezer compartment removed.

As shown in FIG. 2, a center flip mullion 110 is pivotally coupled to at least one of the doors 106 to establish a surface against which a seal provided to the other one of the doors 106 can seal the entrance to the fresh food compartment 102 at a location between opposing side surfaces 112 of the doors 106. The center flip mullion 110 can be pivotally coupled to the door 106 to pivot between a first orientation that is substantially parallel to a planar surface of the door 106 when the door 106 is closed, and a different orientation when the door 106 is opened. The externally-exposed surface of the center flip mullion 110 is substantially parallel to the door 106 when the center flip mullion 110 is in the first orientation, and forms an angle other than parallel relative to the door 106 when the center flip mullion 110 is in the second orientation. The seal and the externally-exposed surface of the center flip mullion 110 cooperate approximately midway between the lateral sides of the fresh food compartment 102.

Moving back to FIG. 1, the freezer compartment 104 is arranged vertically beneath the fresh food compartment 102. A drawer assembly (not shown) including one or more freezer baskets (not shown) can be withdrawn from the freezer compartment 104 to grant a user access to food items stored in the freezer compartment 104. The drawer assembly can be coupled to a freezer door 114 that includes a handle 116. When a user grasps the handle 116 and pulls the freezer door 114 open, at least one or more of the freezer baskets is caused to be at least partially withdrawn from the freezer compartment 104.

Figure 10:
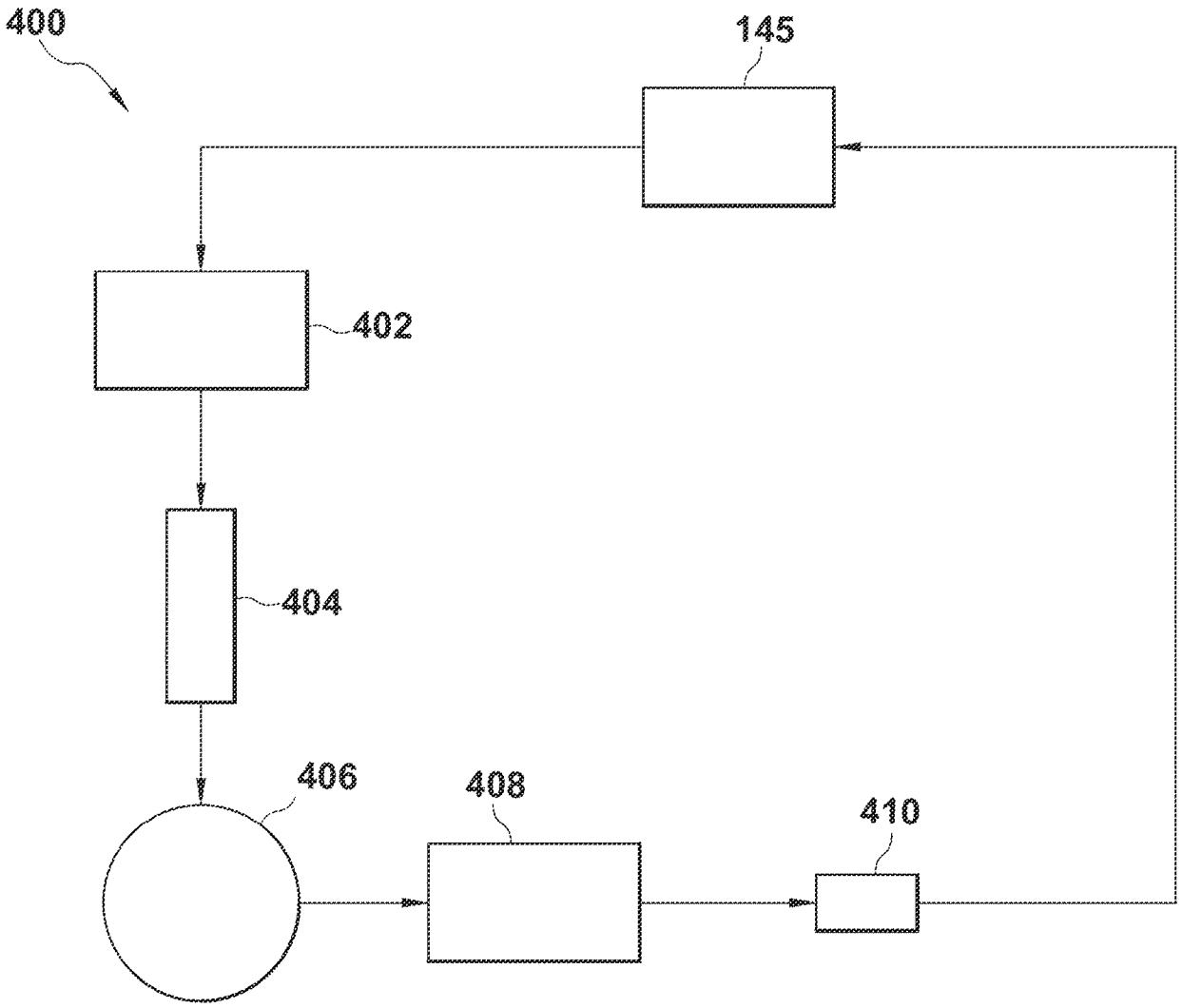
FIG. 10 is a schematic example of a cooling system of the refrigerator of FIG. 1.

Referring to FIG. 10, an example cooling system 400 of the refrigerator 100 is schematically shown. The cooling system 400 includes conventional components, such as a freezer evaporator 402, an accumulator 404 (optional), a compressor 406, a condenser 408, a dryer 410, and a dedicated ice maker evaporator 145, as discussed further below. These components are conventional components that are well known to those skilled in the art and will not be described in detail herein.

The freezer compartment 104 is used to freeze and/or maintain articles of food stored therein in a frozen condition. For this purpose, the freezer compartment 104 is in thermal communication with the freezer evaporator 402 that removes thermal energy from the freezer compartment 104 to maintain the temperature therein at a temperature of 0° C. or less during operation of the refrigerator 100, preferably between 0° C. and −50° C., more preferably between 0° C. and −30° C. and even more preferably between 0° C. and −20° C.

Moving back to FIG. 2, the refrigerator 100 further includes an interior liner comprising a fresh food liner 118 and a freezer liner 120 which define the fresh food and freezer compartments 102, 104, respectively. The fresh food compartment 102 is located in the upper portion of the refrigerator 100 in this example and serves to minimize spoiling of articles of food stored therein. The fresh food compartment 102 accomplishes this by maintaining the temperature in the fresh food compartment 102 at a cool temperature that is typically above 0° C., so as not to freeze the articles of food in the fresh food compartment 102. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator 402 can also be blown into the fresh food compartment 102 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator (not shown) can optionally be dedicated to separately maintaining the temperature within the fresh food compartment 102 independent of the freezer compartment 104. According to an embodiment, the temperature in the fresh food compartment 102 can be maintained at a cool temperature within a close tolerance of a range between 0° C. and 4.5° C., including any subranges and any individual temperatures falling with that range. For example, other embodiments can optionally maintain the cool temperature within the fresh food compartment 102 within a reasonably close tolerance of a temperature between 0.25° C. and 4° C.

With respect to FIG. 1, a dispenser 122 is disposed at one of the doors 106 and is provided to dispense liquid (e.g., water) and/or ice pieces therefrom. As shown, the dispenser 122 is provided on an exterior of one of the doors 106 such that a user can acquire water and/or ice pieces without opening said door 106. Alternatively, it is contemplated that the dispenser 122 can be positioned on an interior of one of the doors 106 or on an interior wall of the refrigerator 100 such that a user must first open said door 106 before interacting with the dispenser 122.

In operation, when a user desires ice (e.g., ice pieces), the user interacts with an actuator (e.g., lever, switch, proximity sensor, etc.) to cause frozen ice pieces to be dispensed from an ice bin 124 (FIG. 2) of an ice maker 126. Ice pieces stored within the ice bin 124 can exit the ice bin 124 through an aperture 128 and be delivered to the dispenser 122 via an ice chute 130. In the embodiment shown, the ice chute 130 extends at least partially through the door 106 between the dispenser 122 and the ice bin 124. As further shown, the ice maker 126 is located within the fresh food compartment 102 and, more particularly, at an upper corner defined by the fresh food liner 118. Alternatively, the ice maker 126 (and possibly the ice bin 124) can be mounted to an interior surface of the door 106. It is further contemplated that the ice maker 126 and the ice bin 124 can be separate elements, in which one remains within the fresh food compartment 102 and the other resides on the door 106.

In alternative embodiments (not shown), the ice maker 126 is located within the freezer compartment 104. In this configuration, although still disposed within the freezer compartment 104, at least the ice maker 126 (and possibly the ice bin 124) is mounted to an interior surface of the freezer door 114. It is contemplated that the ice maker 126 and ice bin 124 can be separate elements, in which one remains within the freezer compartment 104 and the other is on the freezer door 114.

Additionally, when a user desires water, the user interacts with the actuator to acquire water from the dispenser 122. Generally, water is directed through a water circuit of the refrigerator 100 wherein it is pumped to the dispenser 122 from an external source (not shown). Typically, such water circuits include a series of water lines (e.g., conduits, tubes, etc.) to transport the water from the external source to the dispenser 122. Filters and water storage tanks are often also employed to filter the water passing therethrough and to store the water (either filtered or unfiltered) for subsequent downstream use.

Figure 3:
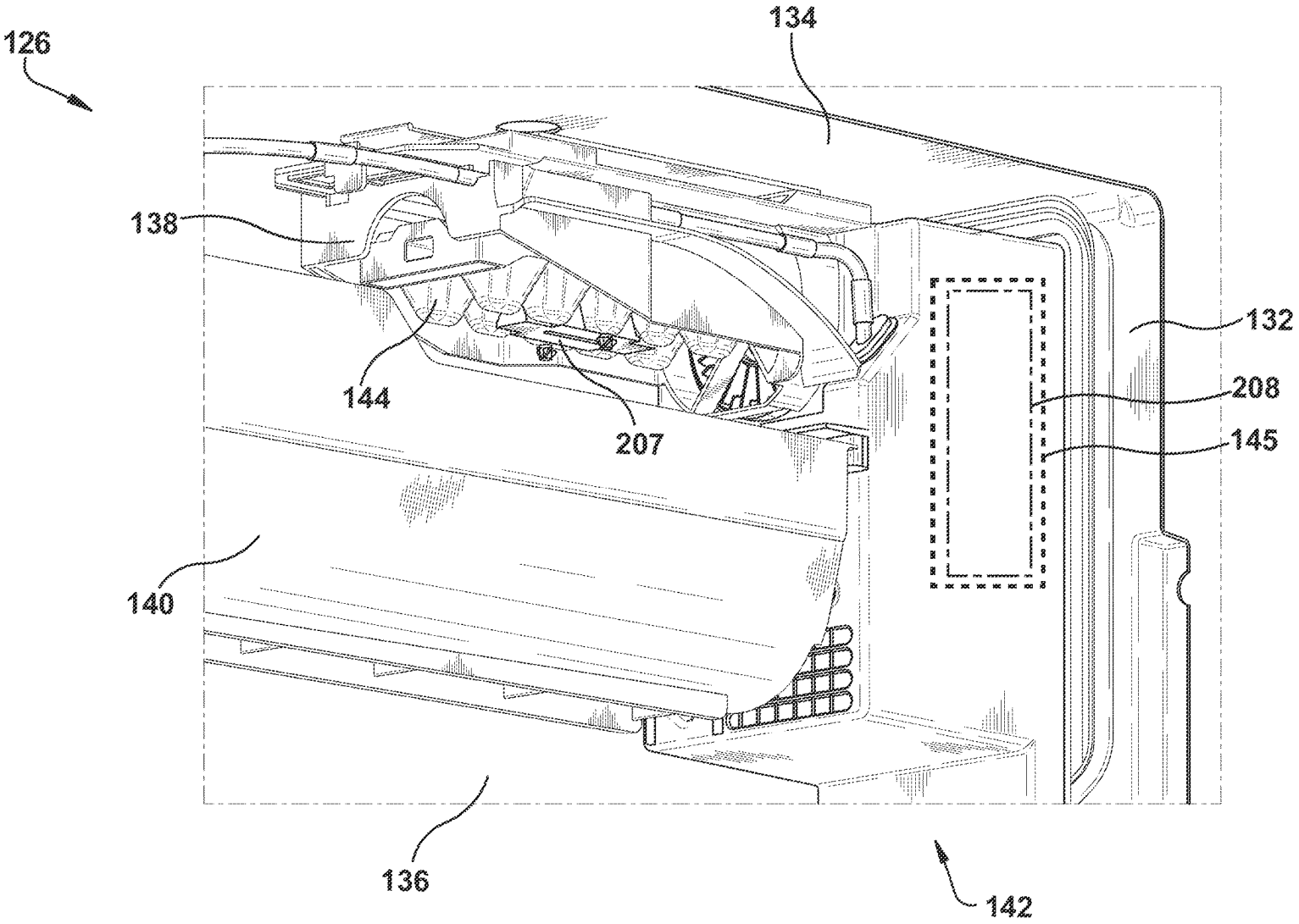
FIG. 3 is a partial, front sectional view of an interior of an upper portion of a refrigerator showing an ice maker.

Moving on to FIG. 3, the ice maker 126 is shown as being disposed at an upper corner of the fresh food compartment 102. Specifically, the ice maker 126 is located adjacent a rear wall 132, top wall 134, and side wall 136 of the fresh food liner 118. Alternatively, the ice maker 126 can be positioned at other locations within the fresh food compartment 102. For example, the ice maker 126 could be positioned at a lower corner of the fresh food compartment 102 (i.e., adjacent a horizontal mullion that separates the fresh food and freezer compartments 102, 104), on a storage shelf located within the fresh food compartment 102, or even on/within one of the doors 106 that provides selective access to the fresh food compartment 102 (as further discussed below).

The ice maker 126 is shown as comprising an ice maker frame 138, an ice bin 140, and an air handler 142. The air handler 142 is secured adjacent the rear wall 132 of the fresh food liner 118, and both the ice maker frame 138 and the ice bin 140 extend outwards therefrom towards a front of the refrigerator 100. Additionally, the ice maker frame 138 is disposed vertically above the ice bin 140 and houses an ice tray 144 therein. Due to this configuration, after the ice pieces have been formed, the ice pieces can then be transported to the ice bin 140 in an efficient manner. For example, the ice tray 144 may rotate about a horizontal axis until the ice pieces face the ice bin 140 and are subsequently ejected from the ice tray 144. Further, the evaporator 145 is disposed within (i.e., positioned behind) the air handler 142. The evaporator 145 is configured to cool water in the ice tray 144 to a temperature sufficient for ice piece production.

Figure 4:
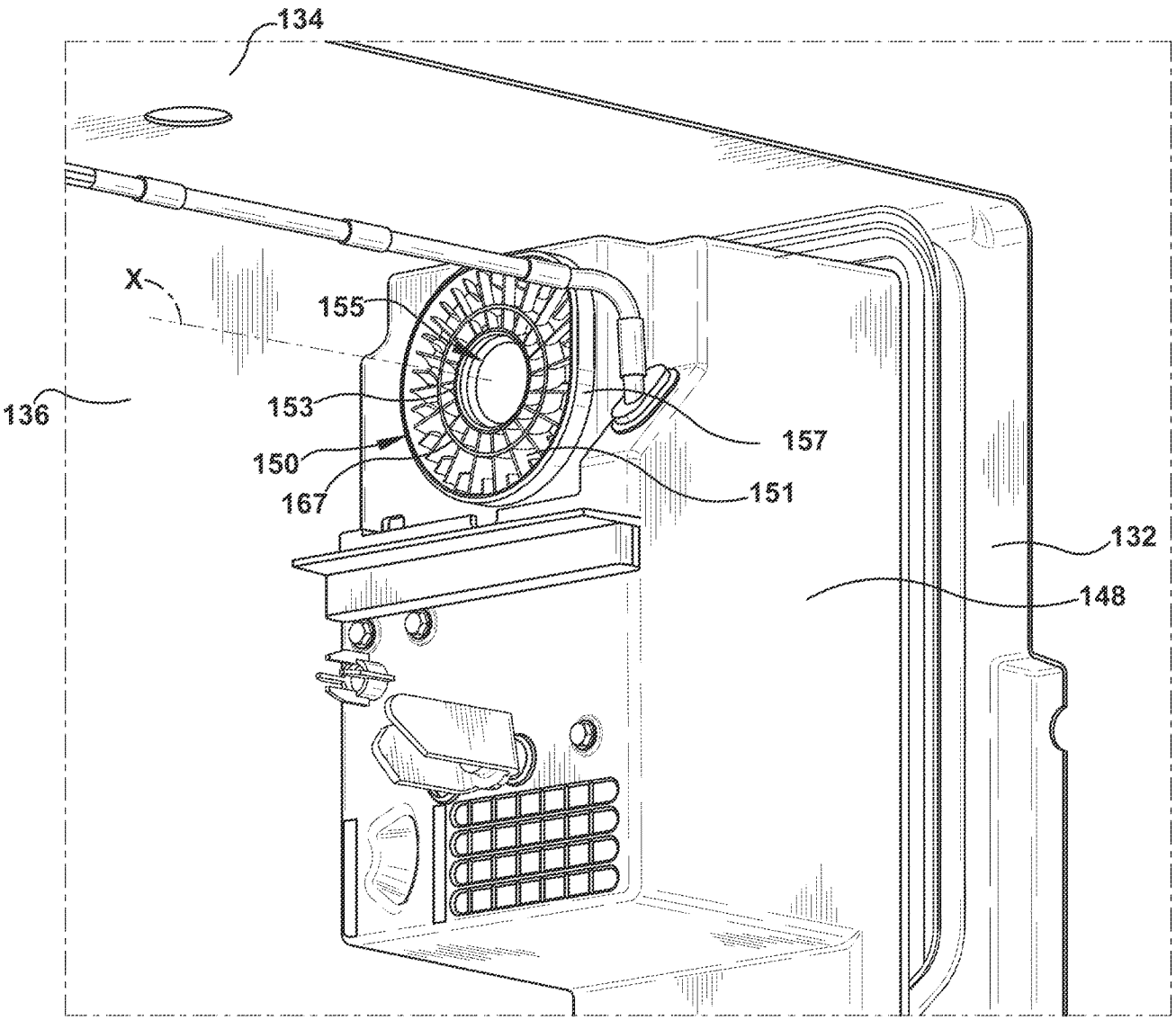
FIG. 4 is a front perspective view of an air handler system of the ice maker shown in FIG. 3.
Figure 6:
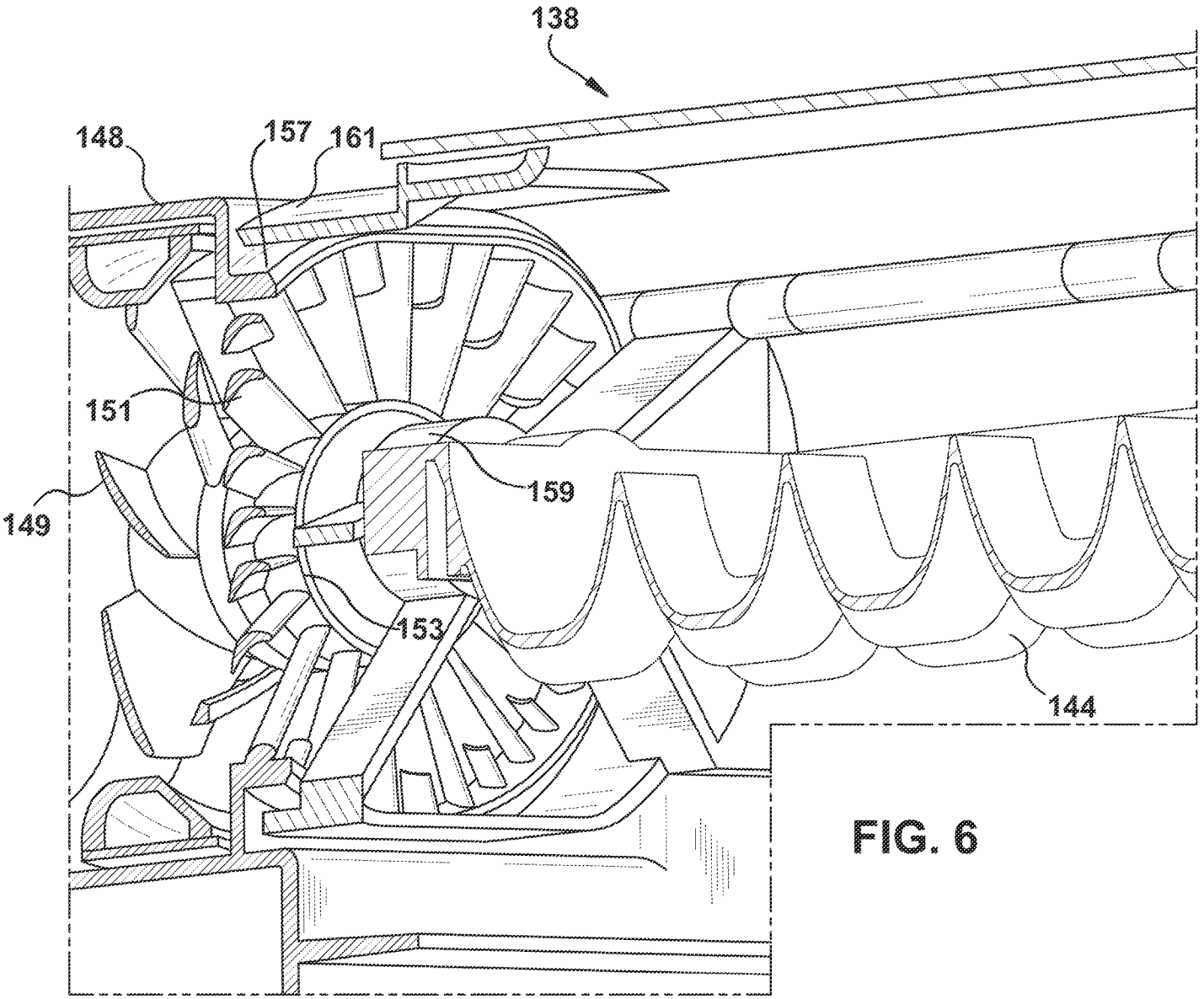
FIG. 6 is a perspective cross-sectional view of the ice maker frame installed adjacent the air handler system.
Figure 7:
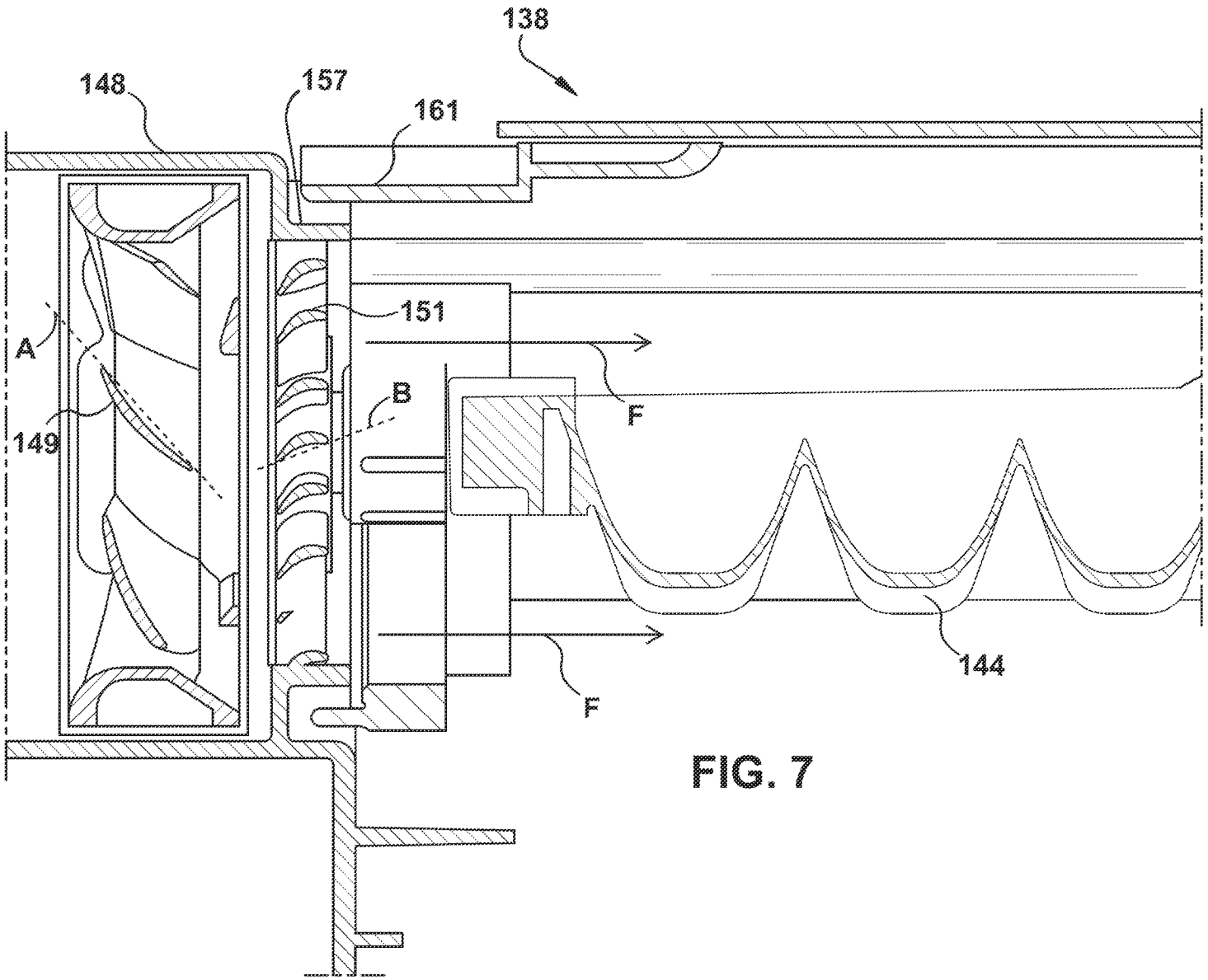
FIG. 7 is a side cross-sectional view of the ice maker frame installed adjacent the air handler system.

With respect to FIG. 4, the air handler 142 comprises a housing 148 that covers (i.e., houses) various components related to the functionality of ice making/dispensing. For example, the housing 148 can house an auger motor, a crush cube solenoid, a fan, EPS foam, electrical harnesses, etc. (not shown). Specifically, as depicted in FIGS. 6-7, a fan 149 is disposed upstream of a fan outlet diffuser 150 formed into the housing 148. The fan outlet diffuser 150 may be formed integral with the housing 148 during a simulations manufacturing process. Alternatively, the fan outlet diffuser 150 may be separate and distinct from the housing 148 such that the fan outlet diffuser 150 is manufactured individually with respect to the housing 148 and subsequently fixed thereto via known methods. Moreover, the fan 149 may be an axial fan, a radial fan, or any other type of fan generally known in the art.

As shown in FIG. 4, the fan outlet diffuser 150 is substantially circular in shape and includes a first wall 153 that defines a central body 155 of the fan outlet diffuser 150. Specifically, the first wall 153 is cylindrical in shape and extends axially along an axis "X." As such, the central body 155 is provided at a radial center of the fan outlet diffuser 150. In one embodiment, the central body 155 can have a closed wall at an end face and/or be solid. In another embodiment, the central body 155 can comprise an aperture extending therethrough. The first wall 153 is peripherally surrounded by a second wall 157. That is, the second wall 157 is radially spaced apart from the first wall 153. Moreover, the second wall 157 is shown as being substantially cylindrical in shape, wherein the first wall 153 and the second wall 157 of the fan outlet diffuser 150 are coaxial. A plurality of radially extending fins 151 are disposed circumferentially about the first wall 153 of the fan outlet diffuser 150. Specifically, the plurality of radially extending fins 151 are disposed between the first wall 153 and the second wall 157, wherein each of the plurality of radially extending fins 151 is spaced apart, one from the other, along an outer peripheral surface of the first wall 153. Alternatively, the fan outlet diffuser 150 can have a different shape (e.g., oval, rectangle, square, triangle, etc.). Optionally, one or more radially extending auxiliary fins can be attached to and disposed circumferentially about one of the first wall 153 or second wall 157, and such auxiliary fins can extend only partially between the first and second walls 153, 157. Further still, an optional third wall 167 can be disposed radially intermediate the first wall 153 and the second wall 157 such that the third wall 167 is coaxial with the first wall 153 and/or the second wall 157.

Figure 5:
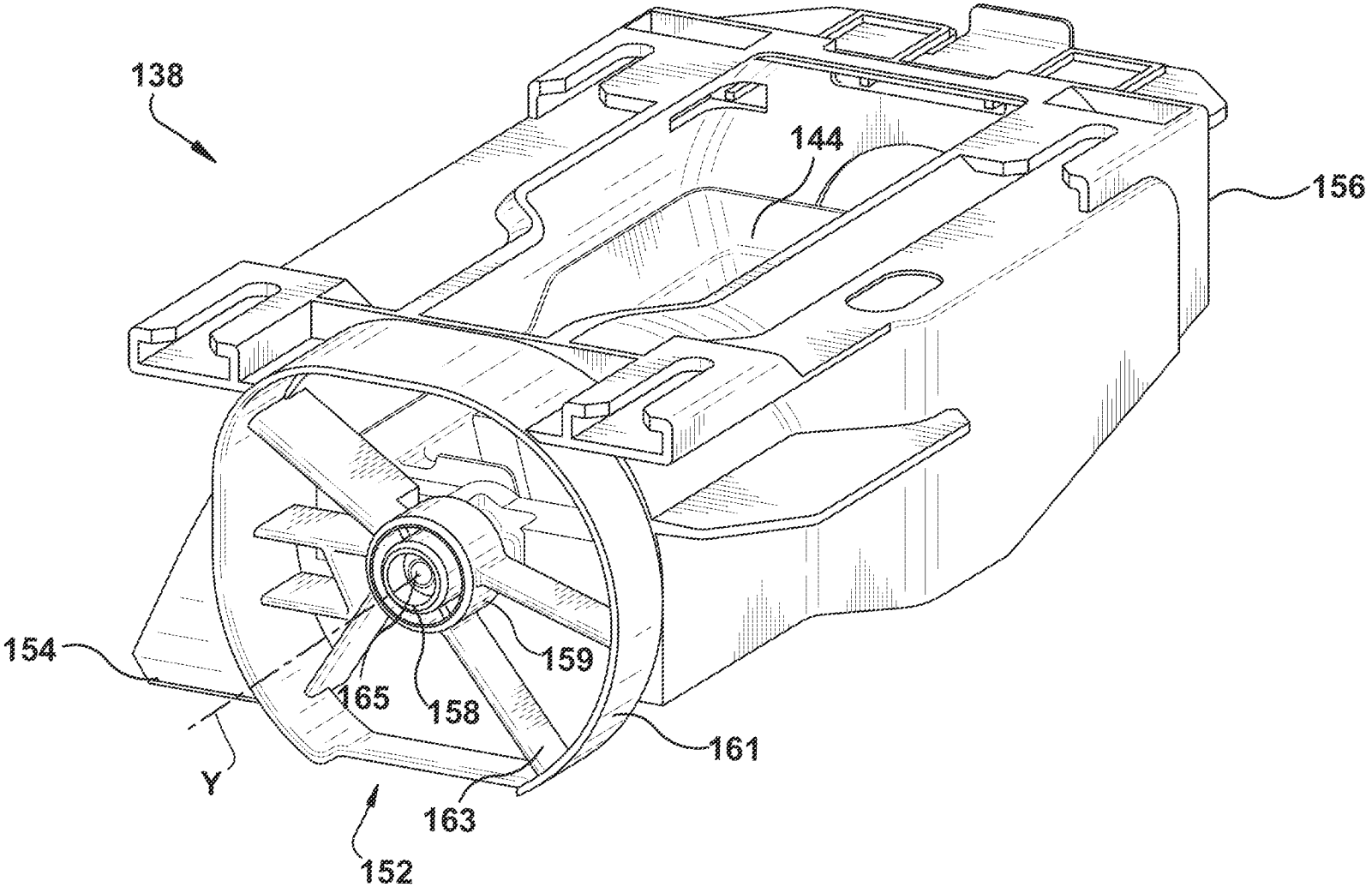
FIG. 5 is a rear perspective view of an ice maker frame of the ice maker shown in FIG. 3.

Moving on to FIG. 5, the ice maker frame 138 includes an air inlet 152 formed at a rear end 154 thereof. The air inlet 152 comprises a first wall 159 having a cylindrical shape and extending along an axis "Y." The first wall 159 of the air inlet 152 is peripherally surrounded by a second wall 161. That is, the second wall 161 of the air inlet 152 is radially spaced apart from the first wall 159 of the air inlet 152, such that the first and second walls 159, 161 are coaxial with one another. At least one projection rib 163 extends between the first and second walls 159, 161 of the air inlet 152, and more particularly, the at least one projection rib 163 extends from the first wall 159 to the second wall 161 of the air inlet 152. The projection rib(s) 163 provides structural rigidity to the air inlet 152 in a manner that does not substantially impede airflow to the ice tray 144, as will be detailed below.

As further shown, the first wall 159 of the air inlet 152 peripherally surrounds a cylindrical connection member 158. The cylindrical connection member 158 is configured to receive a pin 165 of the ice tray 144 in order to rotatably support the ice tray 144. Specifically, the ice tray 144 extends from the rear end 154 of the ice maker frame 138 towards a front end 156 of the ice maker frame 138 and is rotatably secured thereto via the cylindrical connection member 158. The cylindrical connection member 158 is disposed at a radial center of the air inlet 152 (i.e., the radial center point of the pin 165 lies on the axis Y). The configuration of the air inlet 152 substantially mirrors that of the fan outlet diffuser 150, discussed above. That is, as will be detailed below, the radial center point of the fan outlet diffuser 150 and that of the air inlet 152 are configured to lie on the same axis.

In an installed position, the air inlet 152 of the ice maker frame 138 circumferentially surrounds the fan outlet diffuser 150. That is, as shown in FIGS. 6-7, the second wall 161 of the air inlet 152 peripherally surrounds the second wall 157 of the fan outlet diffuser 150. Moreover, the first wall 153 of the fan outlet diffuser 150 is disposed directly adjacent the first wall 159 of the air inlet 152 such that the former and the latter are coaxial with one another (i.e., a radial center point of the first wall 153 of the fan outlet diffuser 150 and that of the first wall 159 of the air inlet 152 lie on a common axis). As such, the fan 149 is positioned relatively close (i.e., adjacent) to the air inlet 152, without any significant obstacles positioned therebetween. In this manner, the air inlet 152 remains substantially unimpeded from obstacles that would otherwise obstruct the air flowing from the air handler 142 to the ice tray 144. This configuration may reduce the number of obstacles between the air handler 142 and the ice tray 144 (as compared to conventional assemblies) so that the fan 149 can direct an airflow out of the outlet diffuser 150 and into the air inlet 152 in an efficient manner, as will be further detailed below.

With respect to FIG. 7, the fan 149 directs an airflow "F" from within the housing 148 of the air handler 142 towards the air inlet 152 of the ice maker frame 138. As shown, a blade of the fan 149 has a directing surface (i.e., a surface configured to drive the airflow F) which decreases (as detailed by a dotted line "A") with respect an imaginary horizontal plane. Further, the radially extending fins 151 have a guiding surface (i.e., a surface configured to guide the airflow F) which increases (as detailed by a dotted line "B") with respect to an imaginary horizontal plane. In other words, the radially extending fins 151 are pitched opposite to the blades of the fan 149. Due to this configuration, the radially extending fins 151 counteract the swirling effect caused by the pitch of the blades such that the airflow F is directed into the ice maker frame 138 in a generally linear manner. It is to be understood that the directing surface of the blades of the fan 149 and the guiding surface of the radially extending fins 151 need not decrease and increase, respectively, with respect to an imaginary horizontal plane. The above-noted surfaces may have any configuration, so long as the pitch of the blades of the fan 149 and the pitch of the radially extending fins 151 are opposite to one another.

Accordingly, due to the geometric configuration of the radially extending fins 151, the airflow F is efficiently directed into the ice maker frame 138 in such a way that the airflow F interacts and cools the entire ice tray 144. That is, the radially extending fins 151 prevent the airflow F from rebounding back into the air handler 142 and/or not interacting/cooling the entire ice tray 144. As such, the cold air from the housing 148 may flow efficiently to the ice tray 144 so that the time it takes for the water within the ice tray 144 to freeze is reduced.

Figure 8:
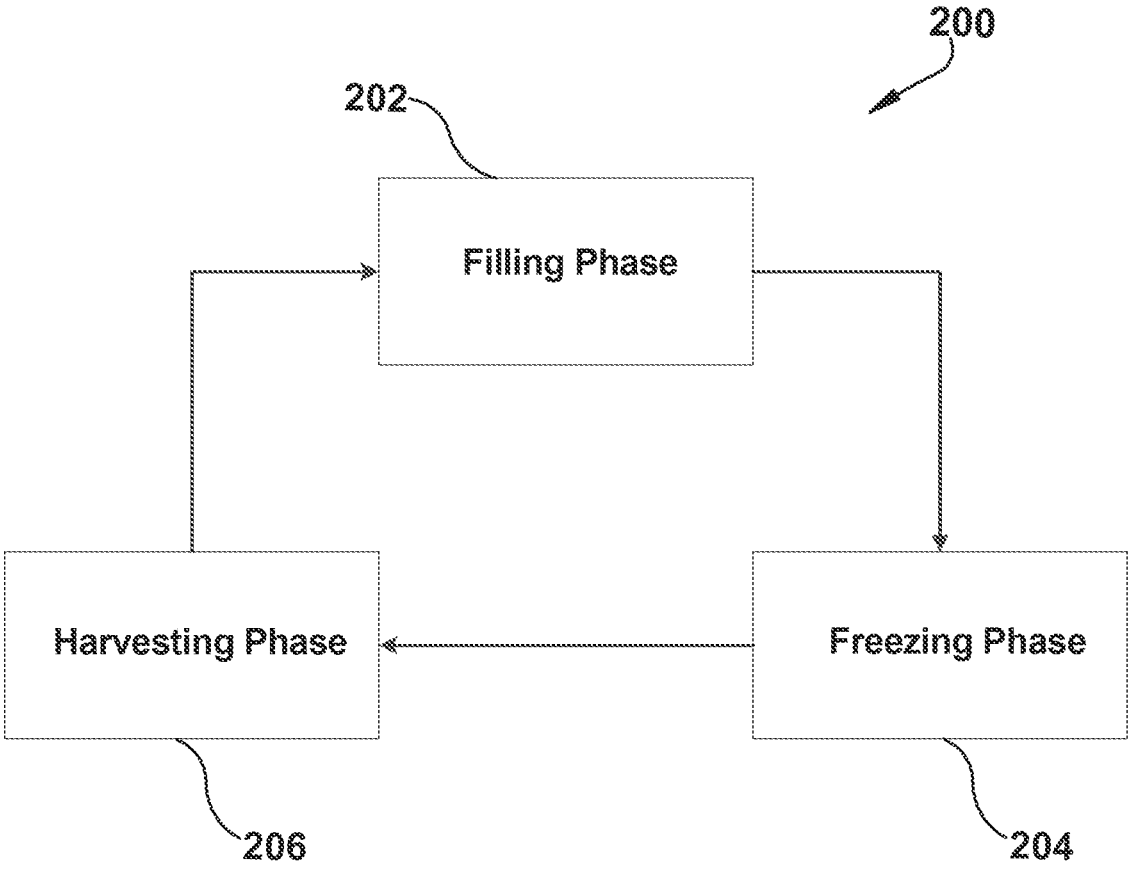
FIG. 8 is a flow chart of an ice making cycle for the ice maker shown in FIG. 3.
Figure 9:
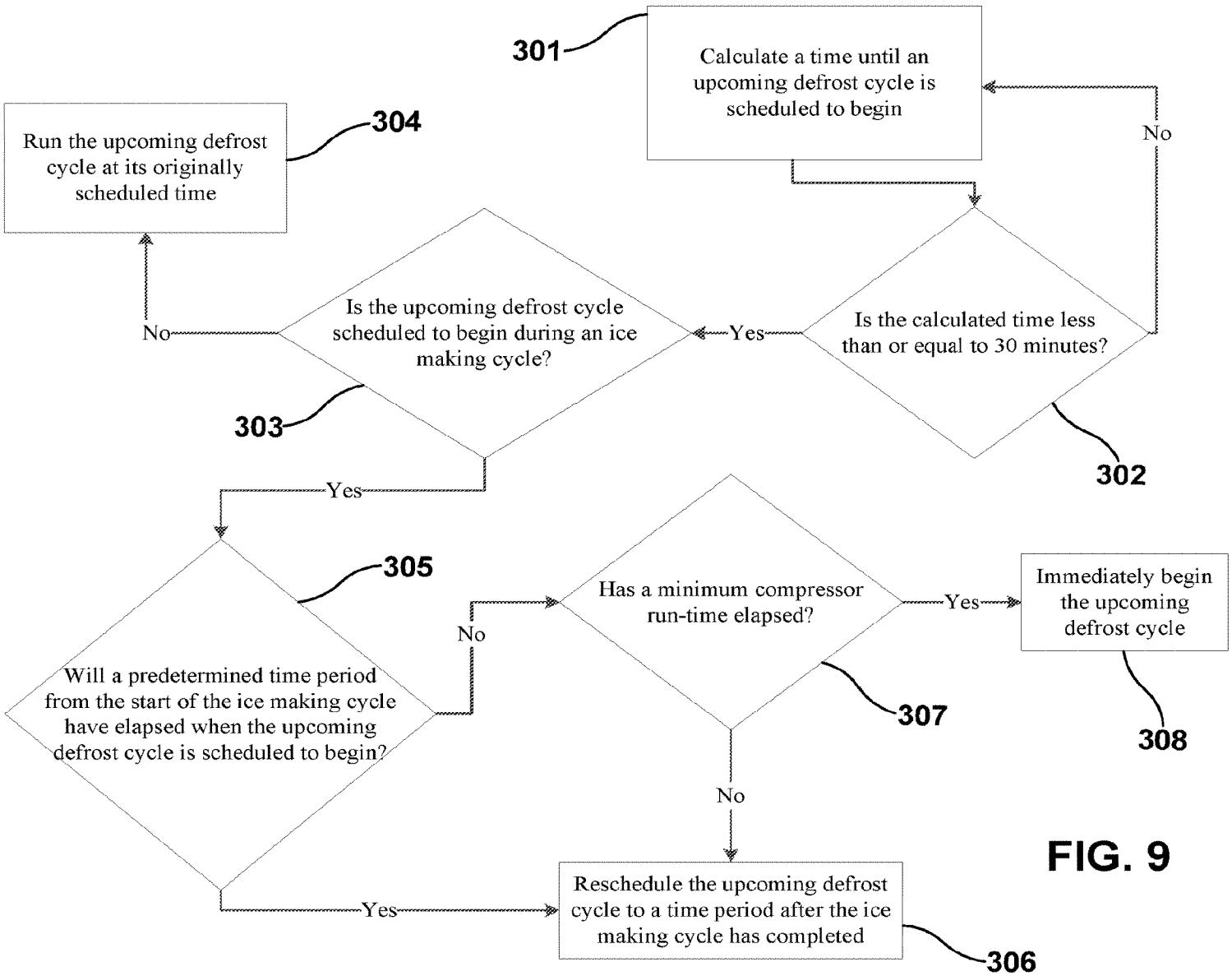
FIG. 9 is a flow chart illustrating synchronizing an implementation of an ice making cycle and an implementation of a defrost cycle.

With reference to FIGS. 8-9, methods of forming ice pieces and operating the ice maker 126 will now be discussed. Specifically, FIG. 8 depicts a flow chart of an ice making cycle 200 of the aforementioned ice maker 126. In an initial step, a filling phase 202 is initiated wherein water, directed from an upstream source, enters the ice tray 144. The water may be transported from an external water source or a source located within the refrigerator 100 (e.g., a water storage tank). Further, the commencement of the filling phase 202 may occur in various ways. For example, the ice maker 126 may include a sensor (e.g., a capacitance sensor) to sense an overall weight of the ice pieces within the ice bin 140 and compare the sensed weight to a predetermined weight indicative of various fill levels of ice pieces (e.g., full, half full, etc.) within the ice bin 140. Alternatively, other sensors may be used to determine a height of the ice pieces within the ice bin 140 to determine whether the ice bin 140 is full. Further still, the filling phase 202 may begin by user request.

Moreover, although not shown, the ice maker 126 may include sensors configured to determine when cavities in the ice tray 144 are filled with water. For example, the sensors may sense when the ice tray 144 is filled and send a signal to a controller 203 (shown schematically in FIG. 1) to stop supplying water to the ice maker 126. Subsequently, after the filling phase 202 of the ice making cycle 200 is completed, a freezing phase 204 begins. Specifically, during the freezing phase 204, a temperature of the water within the ice tray 144 is reduced. This is accomplished by the evaporator 145 (disposed within the air handler 142) lowering the temperature within the ice maker 126 to permit a phase change of the water within the ice tray 144. That is, the air within the ice maker 126 is cooled to a temperature that promotes the liquid water to freeze into solid ice pieces.

After the freezing phase 204 has concluded (i.e., the water within the ice tray 144 has frozen into ice pieces), a harvesting phase 206 may begin. As briefly noted above, the function of the harvesting phase 206 is directed towards disengaging the ice pieces from the ice tray 144 and transferring the ice pieces to the ice bin 140. Before the harvesting phase 206 begins, several criteria must first be met. Specifically, a sensed temperature must be below a maximum harvest temperature and a minimum freeze time must be met.

The maximum harvest temperature is the maximum temperature of the ice pieces in the ice tray, as detected by a sensor (e.g., a thermistor), at which harvesting can occur. In one embodiment (see FIG. 3), the temperature sensor (not shown) may be positioned on a bottom of the ice tray 144. Specifically, the temperature sensor may be inserted into a reception area formed into the ice tray 144 or, alternatively, be disposed adjacent a bottom thereof. Further, insulation (e.g., foam block insulation 207, as depicted in FIG. 3) is generally provided about the sensor (e.g., surrounding the sensor) so as to thermally isolate the temperature sensor from air within the ice maker 126. In this manner, the temperature sensor is capable of providing an accurate reading of the temperature of the water/ice within the ice tray 144, which is uninfluenced by the temperature of the air within the ice maker 126.

During operation, the temperature sensed by the sensor must be below (i.e., colder) the maximum harvest temperature. The minimum freeze time is directed toward a minimum amount of time between the completion of the filling phase 202 and the initiation of the harvesting phase 206. That is, the minimum freeze time is a pre-set time period which must occur before the harvesting phase 206 initiates. Of note, the sensed temperature being below the maximum harvest temperature can be achieved before the minimum freeze time is reached, and vise-versa; however, the harvest phase 206 will not begin until both of the foregoing conditions are met.

As mentioned above, after the harvesting phase 206 begins, the ice pieces are ejected from the ice tray 144 and stored in the ice bin 140. Thereafter, the ice making cycle 200 may continue its operation by initiating the filling phase 202 once more. The ice making cycle 200 may be in constant operation until it is determined that the ice bin 140 has been filled with ice pieces. Alternatively, a predetermined time period may occur between each ice making cycle 200.

Over time, due to the cold environments associated with the overall refrigerator 100 and the ice maker 126, a layer of frost often builds up on evaporators associated therewith. This can occur with an evaporator associated with the main cooling system of the refrigerator (i.e., a system evaporator which maintains the fresh food and/or freezer compartment 102, 104 at an appropriate operating temperature), or an evaporator dedicated to the ice maker 126, such as the evaporator 145 positioned within the air handler 142. The following disclosure is directed towards defrosting various elements associated with the ice maker 126 (e.g., the evaporator 145 within the air handler 142), however, it is to be understood that the disclosure is likewise applicable to any other element employed by the refrigerator 100.

To remove the build-up of frost formed on the evaporator 145, a defrost heater 208 is employed in the refrigerator 100. As schematically shown in FIG. 3, the defrost heater 208 may be positioned within the air handler 142. However, it is contemplated that the defrost heater 208 may be positioned outside the air handler 142, but directly adjacent the ice maker 126, or at any other location within the refrigerator 100. Specifically, the defrost heater 208 may be a resistive heating element that contacts or is in close proximity to the evaporator 145. However, it is contemplated that the defrost heater 208 can be of a different configuration known in the art. The defrost heater 208 is configured to heat the one or more evaporators (e.g., evaporator 145) of the refrigerator 100. In doing so, the increase in temperature eliminates (i.e., melts) the frost on the one or more evaporators. To ensure that this frost is continuously eliminated, the controller 203 includes an algorithm that employs a defrost cycle that operates the defrost heater 208 a predetermined number of times over a predetermined time period.

Specifically, the present method synchronizes the implementation of the ice making cycle 200 of the ice maker 126 and the implementation of the defrost cycle associated with the one or more evaporators (e.g., evaporator 145) to hinder interruption of the ice making cycle 200. In this manner, neither the ice making cycle 200 of the ice maker 126 nor the defrost cycle associated with the one or more evaporators (e.g., evaporator 145) has priority over the other.

With respect to FIG. 9, this synchronization is accomplished via the algorithm employed by the controller 203. Specifically, the algorithm begins with a first step 301 of calculating a time until an upcoming defrost cycle is scheduled to occur. Of note, this and the below reference of "time" may be based on a real time clock used by the controller 203 of the refrigerator 100. For example, during installation of the refrigerator 100 the real time clock may be programmed with the actual time of day. Alternatively, the "time" may be tracked or determined via a counting device that determines and/or outputs how much time (e.g., seconds, minutes, hours, etc.) has elapsed. The timer may be initiated based on the occurrence of a predetermined event. Further still, it is contemplated that the "time" may be generated by other known methods/techniques known in the art.

Subsequently, a second step 302 determines whether the calculated time (from the first step 301) is less than or equal to a predetermined time period. For example, FIG. 9 depicts that this predetermined time period is 30 minutes. However, it is contemplated that other time periods (e.g., greater than or less than 30 minutes) may be used. If the calculated time is greater than 30 minutes, then the algorithm reverts back to the first step 301. Alternatively, if the calculated time is less than or equal to the predetermined time period (i.e., 30 minutes), then a third step 303 occurs where an inquiry is made as to whether the upcoming defrost cycle will begin during an ice making cycle 200. That is, the third step 303 determines whether the ice maker 126 will be in any one of the filling phase 202, the freezing phase 204, and the harvesting phase 206 when the upcoming defrost cycle is scheduled to begin.

If the upcoming defrost cycle is not scheduled to begin during an ice making cycle 200, then operation of the upcoming defrost cycle will begin at its originally scheduled time, as shown in a fourth step 304. Of note, after the determination has been made that the upcoming defrost cycle is not scheduled to begin during an ice making cycle 200, the algorithm may begin once more at the first step 301. In this manner, it is ensured that the upcoming defrost cycle will not overlap or simultaneously run with an ice making cycle 200.

Alternatively, if the upcoming defrost cycle is scheduled to begin during an ice making cycle 200, then an inquiry is made to determine at what point in time during the operation of the ice making cycle 200 the upcoming defrost cycle is scheduled to begin. Specifically, in a fifth step 305, an inquiry is made as to whether a predetermined time period, from the start of the ice making cycle 200, will have elapsed when the upcoming defrost cycle is scheduled to begin. This predetermined time period can be equivalent to half of the overall time period it takes for the ice making cycle 200 to complete operation. That is, if the ice making cycle 200 operates for a time period of 60 minutes, then the predetermined time period may be 30 minutes. Alternatively, the predetermined time period may be any other amount of time.

With respect to the above-example, if the upcoming defrost cycle is scheduled to begin after 30 minutes from the start of the ice making cycle 200 (i.e., within the second half of the ice making cycle 200), then the controller 203 reschedules the upcoming defrost cycle to begin operation after the ice making cycle 200 has completed, as shown in a sixth step 306. That is, the upcoming defrost cycle will not begin at its originally scheduled time period. Rather, the upcoming defrost cycle will begin at a later time period, after the ice making cycle 200 has completed. Of note, the controller 203 can reschedule the upcoming defrost cycle to begin immediately after the ice making cycle 200 has completed, or at a predetermined time period after the ice making cycle 200 has completed.

Alternatively, with respect to the fifth step 305, if the upcoming defrost cycle is scheduled to begin within 30 minutes from the start of the ice making cycle 200 (i.e., within the first half of the ice making cycle 200), then an inquiry is made, as shown in a seventh step 307, as to whether a minimum compressor run-time has elapsed since the completion of a previous defrost cycle. The minimum compressor run-time may be, for example, eight hours, and is generally indicative of an industrial requirement for a minimum amount of time the compressor 406 must be operational between consecutive defrost cycles. It is to be understood that the above-noted minimum compressor run-time need not be eight hours, and that any other predetermined amount of time may be used.

If the minimum compressor run-time has not elapsed (i.e., the compressor has been operational for less than eight hours since the completion of the previous defrost cycle), then the controller 203 reschedules the upcoming defrost cycle to begin operation after the ice making cycle 200 has completed, as shown in the sixth step 306. After the sixth step 306, the algorithm may once again revert back to the first step 301.

Alternatively, if the minimum compressor run-time has elapsed (i.e., the compressor has been operational for greater than or equal to eight hours since the completion of the previous defrost cycle), then the controller 203 reschedules the upcoming defrost cycle to begin operation immediately, as shown in an eighth step 308. In other words, the controller 203 will immediately initiate operation of the upcoming defrost cycle, as opposed to waiting until the upcoming defrost cycle's originally scheduled start time. Of note, after the upcoming defrost cycle has be rescheduled to begin immediately, and after said defrost cycle has been completed, the algorithm may once again revert back to the first step 301.

While not shown, the algorithm will only delay the upcoming defrost cycle for a predetermined maximum period of time. It is contemplated that this predetermined maximum period of time is selected such that in the case of a fault (e.g., a hardware failure), the controller 203 does not continue to wait for an abnormally long period of time. This predetermined maximum period of time is preferably 90 minutes, and even more preferably 60 minutes; however, it is contemplated that the predetermined maximum period of time may be any other amount of time. For example, after the sixth step 306, the controller 203 may initiate a timer. If the timer reaches the predetermined maximum period of time, and the upcoming defrost cycle has not yet begun, then the controller 203 will immediately cancel operation of the present ice making cycle 200 and begin operation of the upcoming defrost cycle, if the predetermined time period in the seventh step 307 has elapsed (i.e., the predetermined time period since the completion of the previous defrost cycle).

As described in detail above, the defrost cycle only occurs when the ice making cycle 200 is not in operation. The implementation of the defrost cycle is either advanced in time or delayed such that the defrost cycle does not overlap with the ice making cycle 200. Accordingly, the aforementioned algorithm synchronizes the implementation of the ice making cycle 200 of the ice maker 126 with the implementation of the defrost cycle of the evaporator 145 so that operation of the ice making cycle 200 is not interrupted.

Accordingly, the aforementioned ice maker 126 configuration and algorithm may increase the overall efficiency of the refrigerator 100. In particular, by preventing the defrost cycle from overlapping the ice making cycle 200, the present configuration and algorithm may reduce the occurrence of unnecessary cooling of the ice tray 144. This elimination in overlap may allow the ice maker to freeze ice in less time and, thereby, increase the daily ice production rate, as compared to conventional ice makers. For example, the daily ice production rate may increase from 2.7-3.0 lbs. of ice per day, for a conventional ice maker, to 3.3-3.5 lbs. of ice per day for the ice maker configuration and algorithm described herein.

Figure 11:
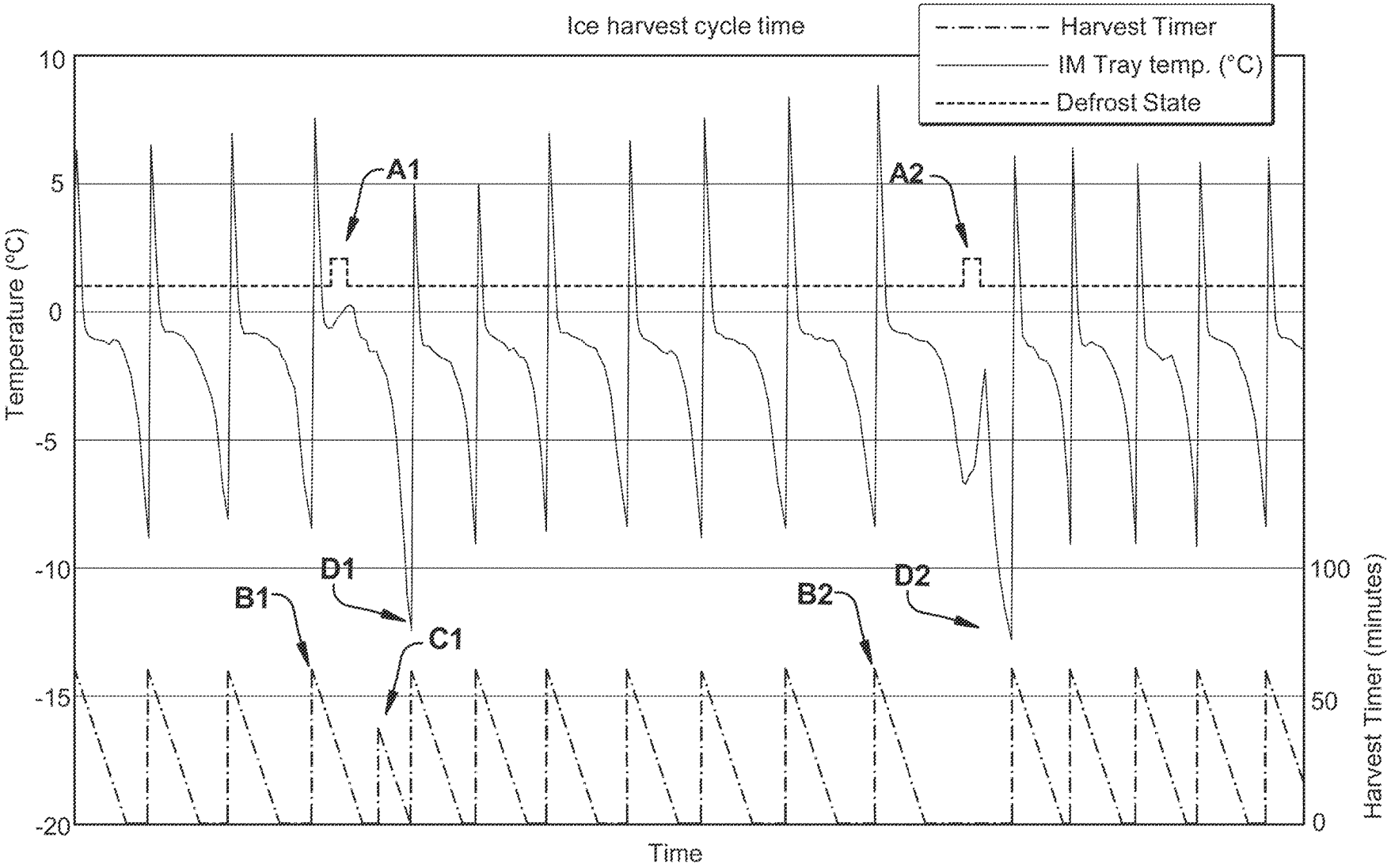
FIG. 11 is a graph representing an ice harvest cycle time when an ice making cycle and a defrost cycle are unsynchronized.

For example, with respect to FIG. 11, a graph of an ice harvest cycle time is shown wherein the ice making cycle and the defrost cycle are unsynchronized. Specifically, the graph is shown with the temperature (° C.) of the ice maker tray 144 represented on the left-hand Y-axis and time represented on the X-axis. Further, the harvest time (in minutes) associated with a timer (i.e., a harvest timer) is represented on the right-hand Y-axis for use with the dot-dash line on the graph. In the cycle illustrated, a first defrost cycle A1 is initiated while an ice making cycle is operating. More particularly, the first defrost cycle A1 is initiated while an initial harvest timer B1 is counting down. Because of the first defrost cycle A1, the controller (e.g., controller 203) stores the time remaining for the initial harvest timer B1 and assigns it to a subsequent harvest timer Cl that is initiated after the completion of the first defrost cycle A1.

As illustrated in FIG. 11, the temperature of the ice tray 144 increases during the first defrost cycle A1. Once the first defrost cycle A1 is completed, the controller (e.g., controller 203) returns to the ice making cycle and initiates the subsequent harvest timer Cl. During the subsequent harvest timer Cl, the temperature of the ice tray 144 achieves a sub-cooling effect D1 (i.e., a temperature of the ice tray 144 substantially surpasses the maximum harvest temperature) which results in an increase in the ice making cycle times as well as requiring higher energy demands.

FIG. 11 also illustrates a second defrost cycle A2 that is initiated while an ice making cycle is operating. Specifically, the second defrost cycle A2 is initiated after a harvest timer B2 has expired, but before the sensed temperature falls below the maximum harvest temperature. After the completion of the second defrost cycle A2, the controller 203 returns to the ice making cycle such that cooling air is again conveyed over the ice maker 126 until the sensed temperature falls below the maximum harvest temperature. This excess cooling causes the ice maker 126 to cool to well below the maximum harvest temperature (i.e., a sub-cooling effect D2). Again, this results in an increase in ice making cycle times as well as higher energy demands.

Figure 12:
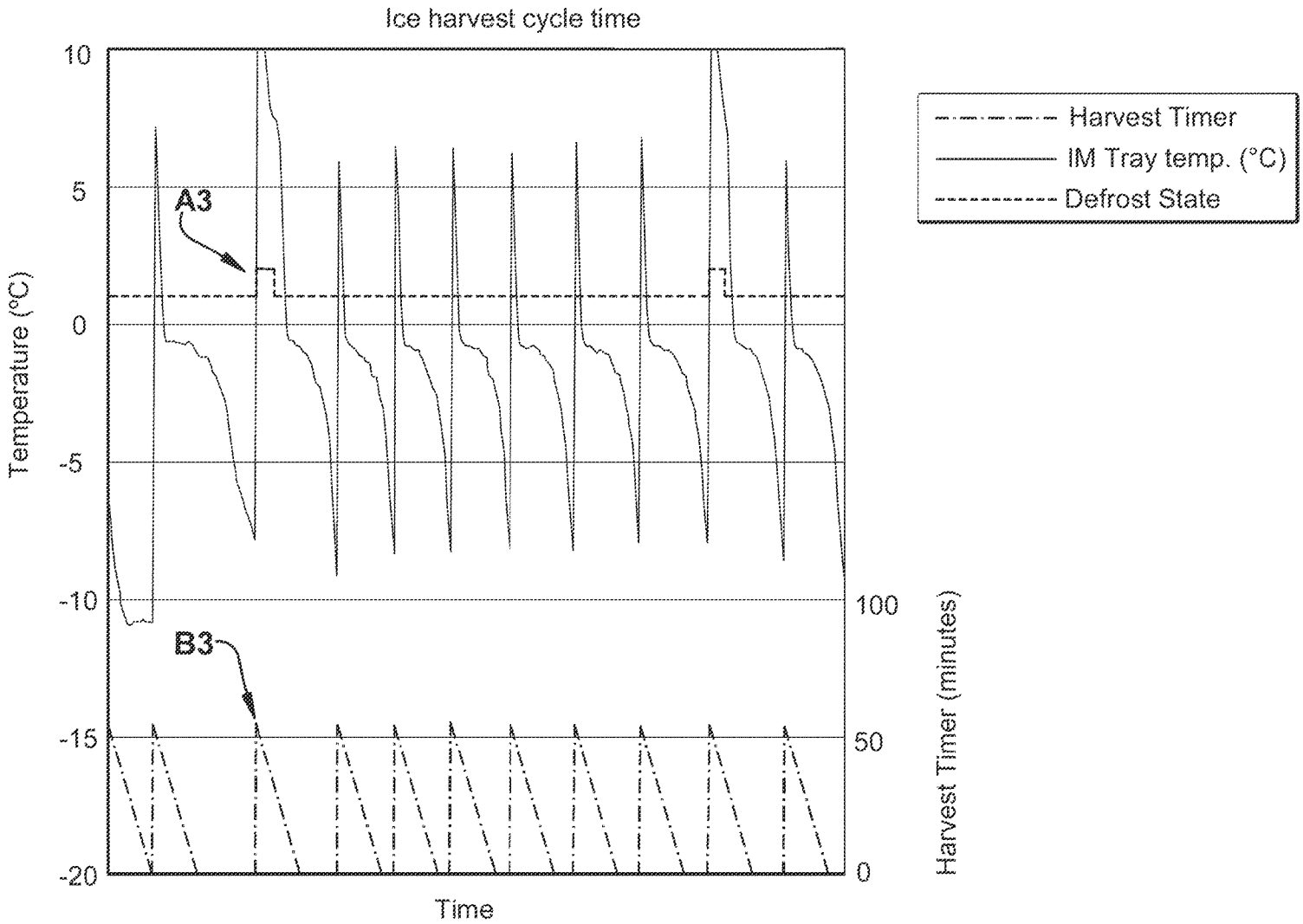
FIG. 12 is a graph representing an ice harvest cycle time when an ice making cycle and a defrost cycle are synchronized.

In contrast, with respect to FIG. 12, a graph of an ice harvest cycle time is shown wherein the ice making cycle and the defrost cycle are synchronized. Again, the graph is shown with the temperature (° C.) of the ice maker tray 144 represented on the left-hand Y-axis and time represented on the X-axis. Further, the harvest time (in minutes) associated with a timer (i.e., a harvest timer) is represented on the right-hand Y-axis for use with the dot-dash line on the graph. The defrost cycle A3 begins at substantially the same time as the harvest timer B3. Although defrost cycle A3 may cause the temperature of the ice maker 126 to increase, the system is able to quickly cool the ice maker 126 after the completion of the defrost cycle A3. The time required to recover from the defrost cycle A3 is short and does not appreciably extend the ice maker cycle. Further, as illustrated in FIG. 12, the sensed temperature of the ice maker 126 does not decrease significantly below the target ice harvest temperature, (i.e., there is no super-cooling effect as illustrated in FIG. 11). Accordingly, no subsequent harvest timer is required, and a sub-cooling effect does not occur.

As briefly mentioned above, the ice maker 126 of the present application may be mounted on the freezer door 114 (shown in FIG. 1). Cold air can be ducted to the freezer door 114 from an evaporator in the fresh food compartment 102 or the freezer compartment (e.g., freezer evaporator 402), including the system evaporator. The cold air can be ducted in various configurations, such as ducts that extend on or in the freezer door 114, or possibly ducts that are positioned on or in side walls of the freezer liner 120 or a top wall of the freezer liner 120. In one example, a cold air duct can extend across the top wall of the freezer compartment 104, and can have an end adjacent to the ice maker 126 (when the freezer door is in the closed condition) that discharges cold air over and across the ice mold. If an ice bin (e.g., ice bin 124) is also located on the interior of the freezer door 114, the cold air can flow downwards across the ice bin 124 to maintain the ice pieces at a frozen state. The cold air can then be returned to the freezer compartment 104 via a duct extending back to the freezer evaporator 402. The ice tray 144 can be rotated to an inverted state for ice harvesting (via gravity or a twist-tray) or may include a sweeper-finger type, and a heater can be similarly used. It is further contemplated that although cold air ducting from the freezer evaporator 402 as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice tray 144. Of course, it is contemplated that the ice maker 126 of the instant application could similarly be adapted for mounting and use on a freezer drawer.

Figure 13:
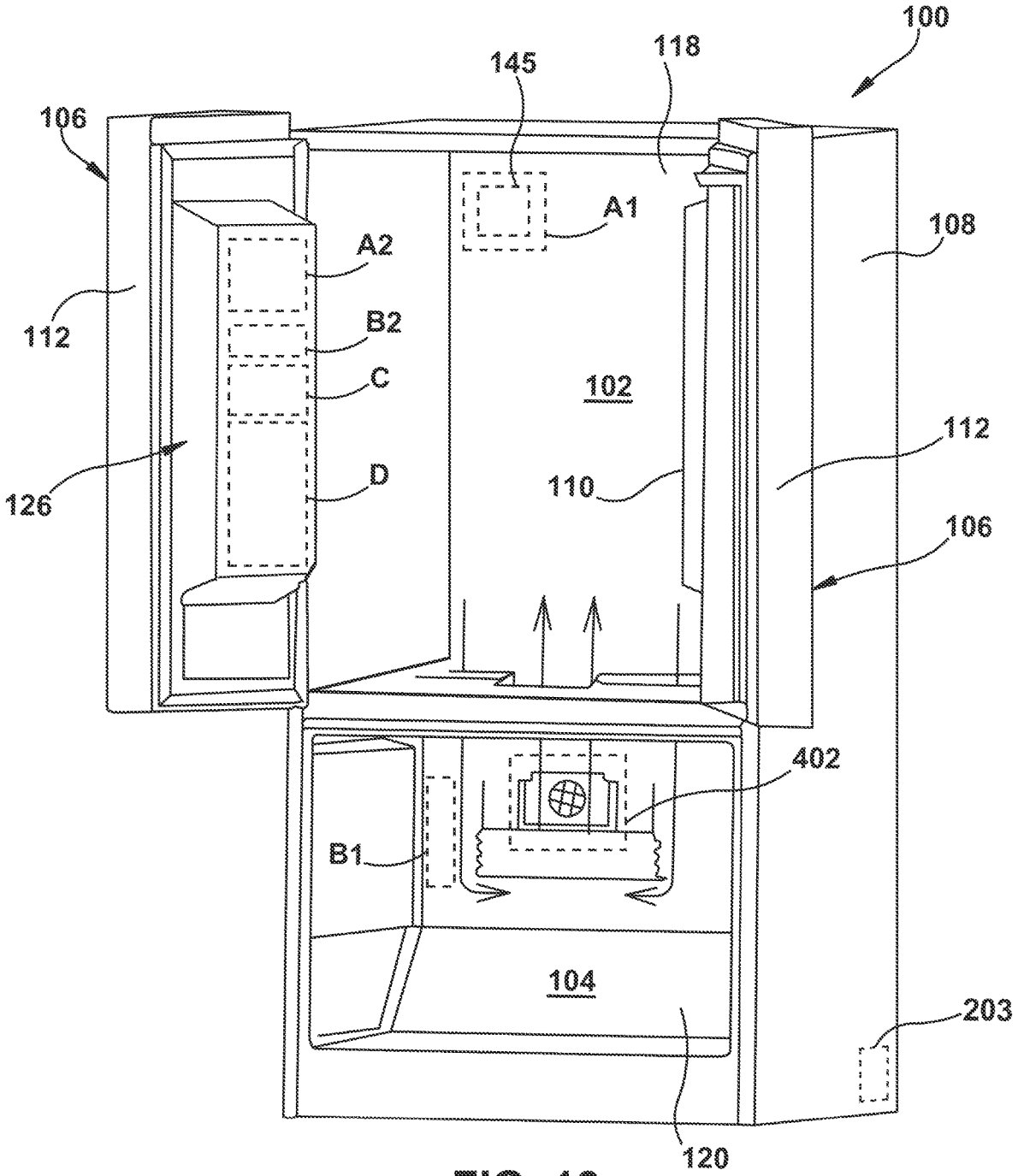
FIG. 13 is a front perspective view of another embodiment of the refrigerator in FIG. 1, showing a plurality of alternative cooling options for an ice maker.

Alternatively, it is further contemplated that the ice maker 126 of the instant application could be used in the fresh food compartment 102, either within the interior of the cabinet 108 or on the door 106 of the fresh food compartment 102. Moving now to FIG. 13, another embodiment of the refrigerator 100 is shown, wherein a plurality of alternative cooling options are depicted for supplying cold air to the ice maker 126 disposed on the door 106 of the fresh food compartment 102. In one example, cold air can be transported to the ice maker 126 from the dedicated ice maker evaporator 145 disposed adjacent the fresh food liner 118 (as discussed above). The cold air can be transported via a ducting system that extends from a first end A1 to a second end A2. For example, as shown, the first end A1 can be disposed on the fresh food liner 118 at the rear wall 132, and may be routed along the rear wall 132, top wall 134, and/or side wall 136, to the second end A2 disposed at the ice maker 126 on the door 106. Of note, the ducting system can include at least one gasket to create a seal when the door 106 is in the closed position. As the cold air enters the ice maker 126, the cold air discharges over and across the ice tray 144 (not shown).

In another example, cold air can be transported to the ice maker 126 from the dedicated freezer evaporator 402 located in the freezer compartment 104. Similar to the example above, the cold air can be transported via a ducting system that extends from a first end B1 to a second end B2. For example, as shown, the first end B1 can be disposed on the freezer liner 120 (i.e., at a rear wall thereof), and may extend along its walls as well as the walls of the fresh food liner 118 to reach the second end B2 disposed at the ice maker 126 on the door 106. Again, the ducting system can include at least one gasket to create a seal when the door 106 is in the closed position.

In a further example, the ice maker 126 can itself include an ice maker evaporator C, similar to the ice maker evaporator 145 discussed above. That is, the ice maker evaporator C is an evaporator connected to the system evaporator of the refrigerator 100 and is located within the ice maker 126 for the purpose of discharging cold air over and across the ice tray 144 (not shown). In yet another example, the ice maker 126 can itself include an ice maker evaporator D, that is completely separate and distinct from the system evaporator of the refrigerator 100. That is, the ice maker evaporator D is an independent refrigeration system located within the ice maker 126 and is configured to discharge cold air over and across the ice tray 144 (not shown).

It is further contemplated that although cold air ducting from the freezer evaporator 402 (or similarly a fresh food evaporator, e.g. the ice maker evaporator 145) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice tray 144. Of course, it is contemplated that the ice maker 126 of the instant application could similarly be adapted for mounting and use on a fresh food drawer.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A method for synchronizing an implementation of an ice making cycle of an ice making unit of a refrigerator and an implementation of a defrost cycle of an evaporator or evaporators associated with the ice making unit and the refrigerator, the ice making cycle including a filling phase, a freezing phase, and a harvesting phase, the method comprising the steps of:

determining whether an upcoming defrost cycle is scheduled to begin when an ice making unit is in a first portion of an ice making cycle or a second portion of the ice making cycle; and if the upcoming defrost cycle is scheduled to begin when the ice making unit is in the second portion of the ice making cycle, then delaying initiation of the upcoming defrost cycle until after the ice making cycle has finished; or if the upcoming defrost cycle is scheduled to begin when the ice making unit is in the first portion of the ice making cycle, then immediately initiating the upcoming defrost cycle by energizing a heating element.

2. The method of claim 1, wherein a duration of time between the upcoming defrost cycle and a previous defrost cycle is equal to or greater than a predetermined minimum duration of time.

3. The method of claim 2, wherein the predetermined minimum duration of time is based on a minimum operating time of a compressor associated with the refrigerator.

4. The method of claim 1, wherein the step of delaying initiation of the upcoming defrost cycle until after the ice making cycle has finished includes repeated inquires to the ice making unit from a controller of the refrigerator.

5. The method of claim 4, wherein said repeated inquiries are performed periodically until it is determined that the ice making unit is not in the freezing phase, the harvesting phase, or the filling phase of the ice making cycle.

6. The method of claim 1, further comprising a step of determining if the step of delaying initiation of the upcoming defrost cycle exceeds a predetermined maximum period of time, and if it is determined that the predetermined maximum period of time has been exceeded, then aborting the ice making cycle and immediately initiating the upcoming defrost cycle.

7. The method of claim 1, wherein, before the step of determining whether the upcoming defrost cycle is scheduled to begin when the ice making unit is in the first portion of the ice making cycle or the second portion of the ice making cycle, a controller calculates a time until the upcoming defrost cycle is scheduled to begin, and wherein only if the calculated time is less than or equal to a predetermined time does the step of determining whether the upcoming defrost cycle is scheduled to begin when the ice making unit is in the first portion of the ice making cycle or the second portion of the ice making cycle occur.

8. The method of claim 1, wherein the step of determining whether the ice making unit is in the first portion of the ice making cycle or the second portion of the ice making cycle is performed by a controller.

9. The method of claim 8, wherein the first portion of the ice making cycle comprises at least one of the filling phase, the freezing phase, and the harvesting phase, and wherein the second portion of the ice making cycle comprises the others of the filling phase, the freezing phase, and the harvesting phase.

10. The method of claim 8, wherein the first portion of the ice making cycle comprises a first half of time of an overall operation time of the ice making cycle, and wherein the second portion of the ice making cycle comprises a second, subsequent half of time of the overall operation time of the ice making cycle.

* * * * *